US009831601B2

(12) United States Patent
Kim

(10) Patent No.: US 9,831,601 B2
(45) Date of Patent: Nov. 28, 2017

(54) CONNECTOR ASSEMBLY HAVING CPA

(71) Applicant: Molex, LLC, Lisle, IL (US)

(72) Inventor: Joon Woo Kim, Ansan (KR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/258,769

(22) Filed: Sep. 7, 2016

(65) Prior Publication Data

US 2017/0077646 A1 Mar. 16, 2017

(30) Foreign Application Priority Data

Sep. 16, 2015 (KR) ..... 10-2015-0130943

(51) Int. Cl.
*H01R 13/627* (2006.01)
*H01R 13/639* (2006.01)

(52) U.S. Cl.
CPC ..... *H01R 13/6272* (2013.01); *H01R 13/639* (2013.01)

(58) Field of Classification Search
CPC ..... H01R 13/6272; H01R 13/6273; H01R 13/639
USPC ..... 439/352
See application file for complete search history.

(56) References Cited

U.S. PATENT DOCUMENTS 5,203,718 A * 4/1993 Chishima ..... H01R 13/641 439/350
6,126,480 A * 10/2000 Kawase ..... H01R 13/6272 439/352
6,312,277 B1 * 11/2001 Holub ..... H01R 13/6272 439/352
6,435,895 B1 * 8/2002 Fink ..... H01R 13/6272 439/352
6,780,045 B2 * 8/2004 Shuey ..... H01R 13/641 439/352
6,811,424 B2 11/2004 Seminara et al.
7,399,195 B2 * 7/2008 Kim ..... H01R 13/641 439/352
9,281,619 B2 * 3/2016 Morello ..... H01R 13/639
2003/0171027 A1 * 9/2003 Shuey ..... H01R 13/641 439/489
2011/0195591 A1 * 8/2011 Mumper ..... H01R 13/6272 439/345
2012/0282791 A1 * 11/2012 Brown ..... H01R 13/639 439/157
2014/0004732 A1 * 1/2014 Heil ..... H01R 13/6275 439/352

* cited by examiner

*Primary Examiner* — Harshad C Patel
(74) *Attorney, Agent, or Firm* — James A. O'Malley

(57) ABSTRACT

A connector assembly is provided which has a connector position assurance apparatus that maintains a required CPA insertion force when the CPA is fastened and before the counterpart connector is fastened.

4 Claims, 9 Drawing Sheets

CONNECTOR ASSEMBLY HAVING CPA

RELATED APPLICATIONS

This application claims priority to Korean Application No. 10-2015-0130943, filed Sep. 16, 2015, which is incorporated herein by reference in its entirety.

TECHNICAL FIELD

This disclosure relates to a connector, and more specifically to a connector assembly having a connector position assurance apparatus.

BACKGROUND ART

Generally, in electronic devices, electrical connectors are furnished for purposes of electrical contact. In addition, a connector position assurance (CPA) apparatus is typically installed to ensure that the connector is in locking position when a counterpart connector is inserted.

For example, the ignition coil connector that supplies electricity to the ignition coil of an automobile has a CPA mounted on one side of the connector housing, and the counterpart connector may be inserted into the forward opening of the connector housing so as to be locked in place. This CPA is required to satisfy a CPA insertion force of at least 8.0 kgf when the CPA is fastened before the counterpart connector is fastened.

However, because connectors having CPAs of the prior art have a structure in which the CPA part is simply fastened to the connector housing, when the 1st CPA is in a fastened state, when assembling the counterpart connector, it is safety-fastened a 2nd time so that the CPA apparatus maintains a CPA insertion force of around 3.0-3.6 kgf. Accordingly, in the prior art, because it has not been possible to achieve the required CPA insertion force of 8.0 kgf or greater prior to fastening the counterpart connector, product reliability has been poor.

In addition, in the prior art, because the structure involves simply fastening the CPA by inserting it into the connector housing in a horizontal direction, the CPA fastening force and removal force have been problematically low.

Patent Reference: Republic of Korea Unexamined Patent Publication No. 10-2006-0002847

SUMMARY

The technical task of this disclosure is to provide a connector assembly having a connector position assurance (CPA) apparatus that maintains a required CPA insertion force when the CPA is fastened and before the counterpart connector is fastened.

Another technical task of this disclosure is to provide a connector assembly having a connector position assurance apparatus that may increase the CPA fastening force and removal force in the assembly process wherein the CPA is fastened to the connector housing.

To achieve the above technical tasks, the connector assembly according to one embodiment of this disclosure may comprise: a housing wherein a forward opening is formed whereinto a counterpart connector is inserted from the front, and a terminal receiving hole is formed within the forward opening, and a connector position assurance (CPA) insertion part is formed in one side so that it is connected to the forward opening, and wherein a locking protrusion is formed on the forward interior of the CPA insertion part so as to prevent forward detachment of the counterpart connector inserted via the forward opening by locking it into place; and a CPA part that assures the locking position of the counterpart connector by being inserted into the CPA insertion part via the rear of the connector housing; the CPA part may further have an edge formed on the front end of the locking lever that contacts the locking protrusion so that when the CPA part is inserted into the CPA insertion part before the counterpart connector has been connected, the front end of the CPA part prevents vertical slippage due to the edge, and the CPA insertion force is kept equal to or greater than a specified force.

In addition, in the CPA part, a downward-curved curved surface on top of the front end of the locking lever may intersect with an upward-inclined inclined surface on the bottom of the front end, so that the edge may be formed protruding forward in an angular shape.

In addition, the CPA part may comprise: a pressing plate having a vertical planar surface; a locking lever extending forward at the center of the pressing plate, and on the front end whereof an edge is formed; and end supports formed in front of either end of the pressing plate and extending so as to be shorter than the locking lever; the CPA part may further be inserted at a downward inclination in the CPA insertion part from behind the connector housing, and the angle of inclination may be varied depending on the stage of CPA insertion so that the CPA fastening force and removal force are satisfied.

In addition, the locking lever may comprise: a horizontal part extending horizontally in a bar shape alongside the end support, in the center of the pressing plate; a bending part that extends bending upward from the front end of the horizontal part, and whereon a rib is formed for reinforcement in the bottom; a lever part bent downward from the front end of the bending part and extending forward alongside the horizontal part; and a locking part formed curving downward on the front end of the lever part, on the front surface whereof the edge is formed.

In addition, on either side of the rear of the interior of the CPA insertion part, side guide recesses may be formed, and when the end supports of the CPA parts are inserted into the side guide recesses, the CPA part may be inserted at an initially downward incline into the CPA insertion part, due to both interference between the bottom of the end supports and the bottom of the side guide recesses, and interference between the top of the locking lever and the top of the CPA insertion part.

In addition, on the bottom surface of the rear of the interior of the CPA insertion part, an inclined projection may be formed, and on the bottom surface of the horizontal part of the locking lever an inclined recess may be formed having an inclined surface corresponding to the inclined projection; and the CPA part may further enter at a downward inclination when the inclined surface of the inclined recess meets the inclined projection when the CPA part is inserted into the CPA insertion part.

The connector assembly having a CPA according to this disclosure has the following effects.

First, this disclosure enables a CPA insertion force to be maintained such that when the connector position assurance (CPA) part has been fastened and prior to the fastening of the counterpart connector, it is able to withstand a force of at least 8.0 kgf, by preventing vertical slippage due to the formation of an edge on the front of the locking lever of the CPA part.

Second, this disclosure enables increased CPA fastening force and removal force by inserting the CPA part from the rear of the connector housing into the CPA insertion part at a downward inclination, and varying the inclination angle depending on the stage of CPA insertion.

Third, this disclosure enables increased tension when fastening the CPA due to the formation of a double round around both edges of the upper surface of the bending part of the CPA part, and also enables the prevention of CPA damage by reinforcing its strength by forming a rib on the lower portion of the bending part.

DETAILED DESCRIPTION OF THE PREFERRED EMBODIMENTS

Hereinbelow, a preferred embodiment of the connector assembly of this disclosure for use in an electronic device will be described, with reference to the attached drawings. Please note that in describing this disclosure, the detailed explanation is omitted of functions and components which are common knowledge and would unnecessarily obscure the substance of the disclosure.

Figure 1:
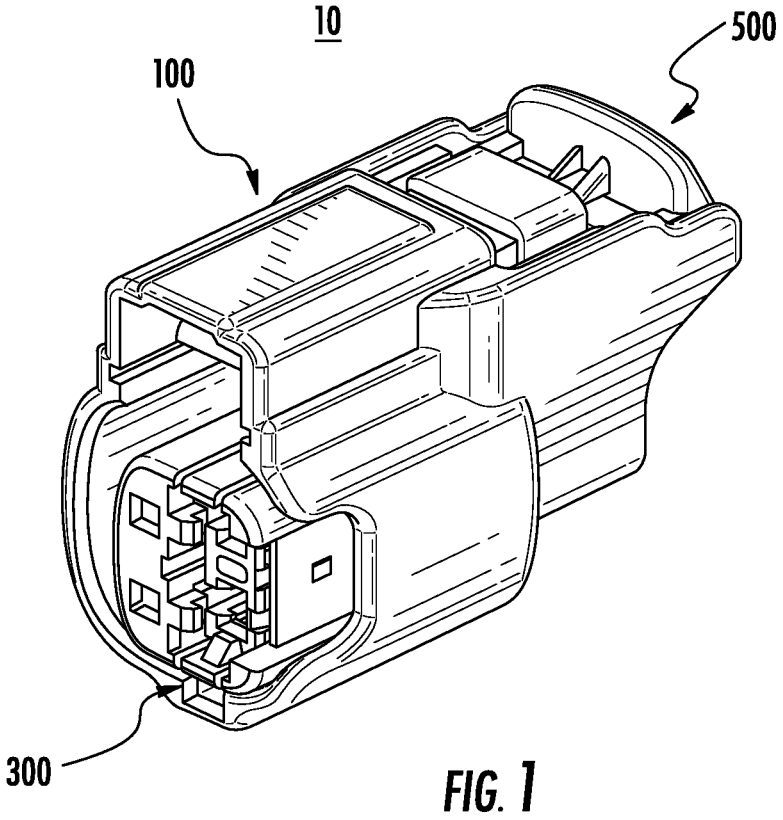
FIG. 1 is a perspective view of a connector assembly according to one embodiment of this disclosure.
Figure 2:
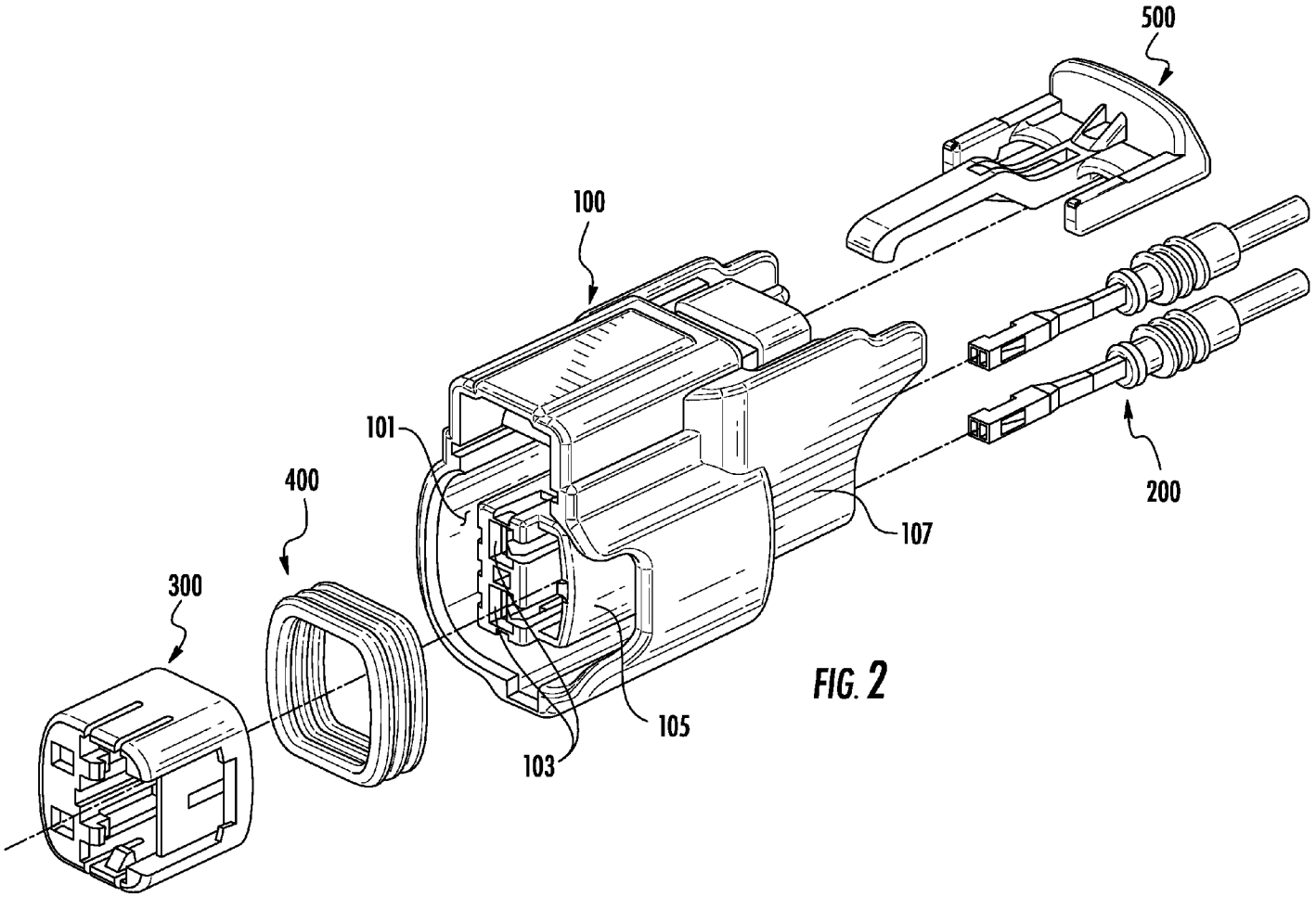
FIG. 2 is an exploded perspective view of FIG. 1.
Figure 3:
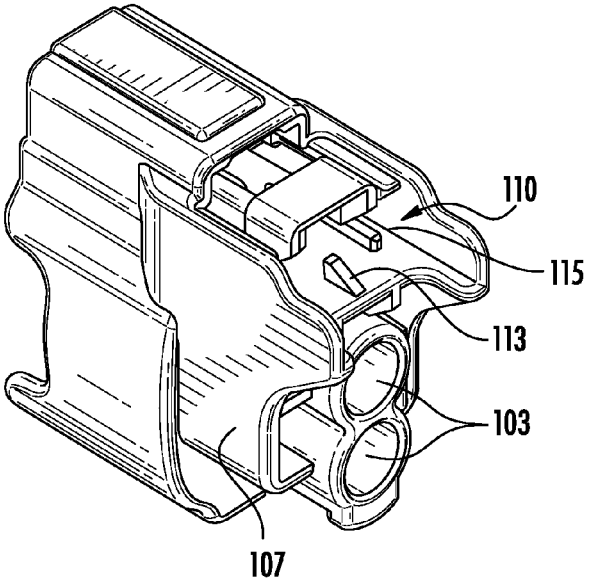
FIG. 3 is a rear perspective view of the connector housing.
Figure 4:
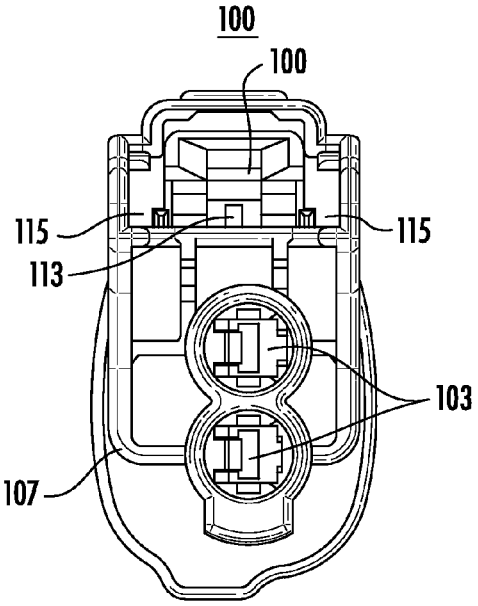
FIG. 4 is a view of the connector housing from the rear.

FIG. 1 is a perspective view of a connector assembly according to one embodiment of this disclosure; FIG. 2 is an exploded perspective view of FIG. 1; FIG. 3 is a rear perspective view of the connector housing; FIG. 4 is a view of the connector housing from the rear.

As shown in FIGS. 1 through 4, the connector assembly 10 according to an embodiment of this disclosure may comprise a housing 100, connector terminal 200, terminal position assurance part 300, sealing part 400, and connector position assurance part 500.

In the connector housing 100, an opening 101 is formed at the front to enable insertion of the counterpart connector 20 (see FIG. 7) from the front, and a terminal receiving hole 103 is formed within this forward opening 101 in a front-to-back direction. In addition, on the front of the connector housing 100, a forward coupling end 105 is formed, and on the rear, a rear terminating end 107 is formed. A pair of terminal receiving holes 103 are formed, spaced apart from one another, in a front-to-back direction between the forward coupling end 105 and rear terminating end 107.

In addition, on one side of the interior of the connector housing 100, a CPA insertion part 110 whereinto below-described the CPA part 500 is inserted is formed, so as to connect with the forward opening 101. In addition, a locking protrusion 111 (see FIG. 7) is formed on the forward interior of the CPA insertion part 110 so as to prevent forward detachment of the counterpart connector 20 inserted via the forward opening 101 by locking it into place.

In addition, in the connector housing 100, side guide recesses 115 are formed on either side of the rear interior of the CPA insertion part 110 so that the end supports 530 (see FIGS. 5A and 5B) of the CPA part 500 may be inserted therein. In addition, on the bottom rear surface of the CPA insertion part 110, an inclined projection 113 is formed, so that when the CPA part 500 is fastened, it is inserted into the inclined recess 521*a* formed on the bottom surface of the horizontal part 521 of the locking lever 520.

A pair of connector terminals 200 are formed so as to be respectively inserted into the pair of terminal receiving holes 103 formed on the connector housing 100. The connector terminals 200 contact the terminals (not shown) of the counterpart connector 20 when the counterpart connector 20 is fastened to the connector housing 100.

The terminal position assurance part 300 is inserted into the forward opening 101 of the connector housing 100 so as to assure the position of the connector terminal 200.

The sealing part 400 is formed in a ring shape, and is inserted into the forward opening 101 before insertion of the CPA part 300 into the connector housing 100 so as to improve watertightness.

The CPA part 500 is mounted on one side of the connector housing 100 so as to fix in place the counterpart connector 20 inserted into the forward opening 101. This CPA part 500 is inserted into the CPA insertion part 110 from the rear of the connector housing 100 so as to assure the locking position of the counterpart connector 20.

Figure 5A:
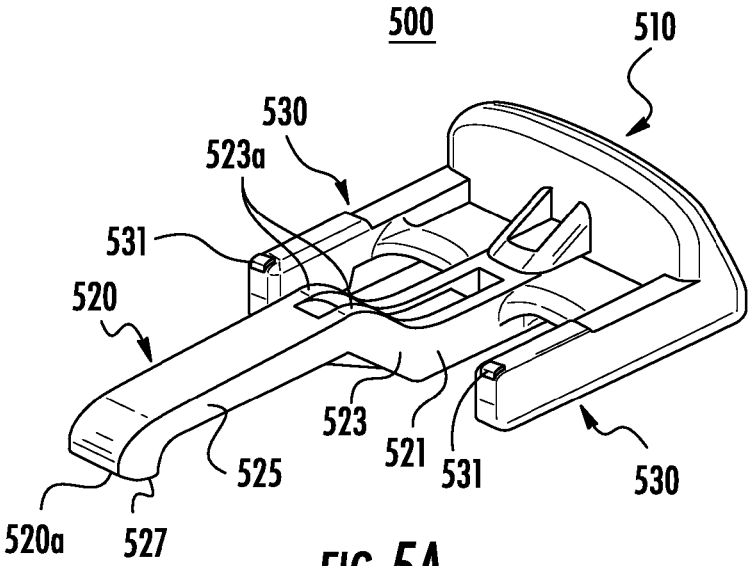
FIGS. 5A and 5B are perspective views of the connector position assurance (CPA) part.
Figure 5B:
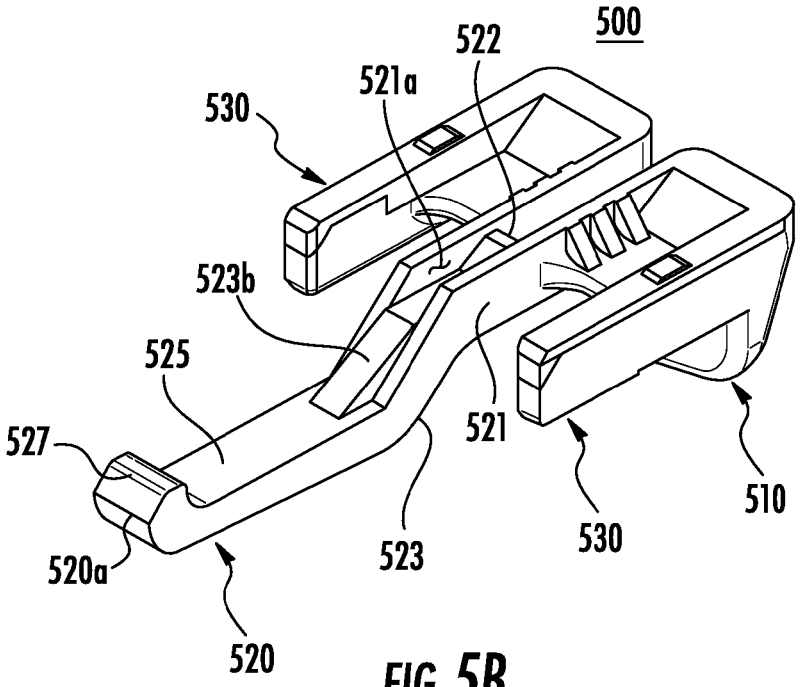
Figure 6:
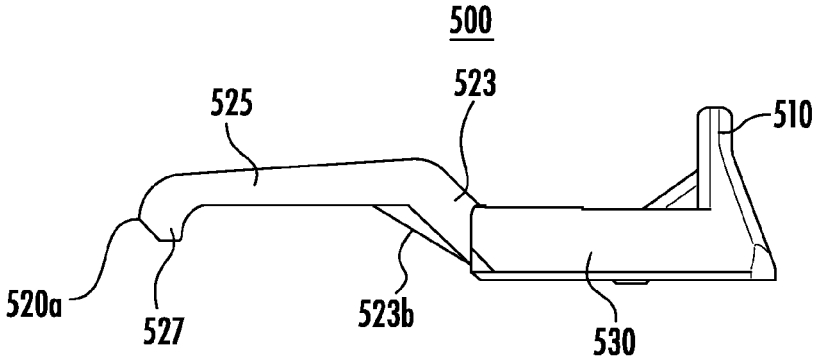
FIG. 6 is a side view of the connector housing.

FIGS. 5A and 5B are perspective views of the connector position assurance CPA part; FIG. 6 is a side view of the connector housing.

As shown in FIGS. 5A, 5B and 6, the CPA part 500 has an edge 520*a* formed on the front end of the locking lever 520 that contacts the locking protrusion 111 formed on the forward interior of the CPA insertion part 110 so that the front end of the CPA part 500 is prevented from slipping vertically when the CPA part 500 is fastened to the CPA insertion part 110 before the counterpart connector 20 is fastened, due to the edge 520*a*, and the CPA insertion force is thereby kept equal to or greater than a specified force, e.g. equal to or greater than 8.0 kgf.

The CPA part 500 may comprise a pressing plate 510, locking lever 520, and end supports 530.

The pressing plate 510 has a vertical planar surface providing a sufficient area that a worker may press it by hand.

The locking lever 520 is formed extending forward on the center of the pressing plate 510, and an edge 520*a* is formed on the front end thereof. The locking lever 520 may comprise a horizontal part 521, bending part 523, lever part 525 and locking part 527.

The horizontal part 521 extends horizontally in a bar shape, in line with the end supports 530 described below, at the center of the pressing plate 510. The horizontal part 521 should preferably be formed at a length approximately the same as that of the end supports 530. On the bottom surface of the horizontal part 521 a inclined recess 521*a* is formed having an inclined surface that corresponds to the inclined projection part 113 formed on the bottom surface of the rear interior of the CPA insertion part 110. Accordingly, when the CPA part 500 is inserted into the CPA insertion part 110, the inclined surfaces of the inclined projection 113 and inclined recess 521*a* meet, while the CPA part 500 enters the CPA insertion part 110 at an initial downward incline.

The bending part 523 is extended bending upward from the front end of the horizontal part 521. Further, due to the formation of a double round 523*a* around both edges of the upper surface of the bending part 523, tension may be increased when fastening the CPA, and due to reinforcement by the formation of a rib 523*b* on the lower portion of the bending part 523, CPA damage may be prevented.

The lever part 525 is bent downward from the front end of the bending part 523 so as to extend forward almost in line with the horizontal part 521.

The locking part 527 is formed bending downward from the front end of the lever part 525 and an edge 520*a* is formed on the front surface thereof. For example, a downward-curved curved surface on the top of the front end of the locking part 527 intersects with an upward-inclined inclined surface on the bottom of the front end, so that an edge 520*a* is formed protruding forward in an angular shape. Accordingly, the front end of the CPA part 500 may be prevented from slipping vertically when the CPA part 500 is fastened to the CPA insertion part 110 before the counterpart connector 20 is fastened, due to the edge 520*a*, and the CPA insertion force may thereby be kept equal to or greater than a specified force, e.g. equal to or greater than 8.0 kgf.

The end supports 530 are respectively formed extending forward from either end of the pressing plate 510. The end supports 530 are formed at a shorter length than the locking lever 520, and preferably at a length approximately the same as that of the horizontal part 521. The end supports 530 are inserted into the side guide recesses 115 formed on either side of the rear interior of the CPA insertion part 110, so as to be supported thereby, when the CPA part 500 is inserted into the CPA insertion part 110. In addition, the CPA part 500 is inserted initially at a downward inclination into the CPA insertion part 110 due to interference between the bottom of the end supports 530 and the bottom of the side guide recesses 115.

In addition, vertical slippage is prevented when the CPA part 500 is inserted into the CPA insertion part 110 due to the formation of a projection 531 on the front end of the top surface of the end supports 530.

In the CPA part 500, a projection 522 is formed that prevents rearward detachment by catching on the inclined projection 113 formed on the rear bottom surface within the CPA insertion part 110 at a location separated by a certain distance from the back end.

Figure 7:
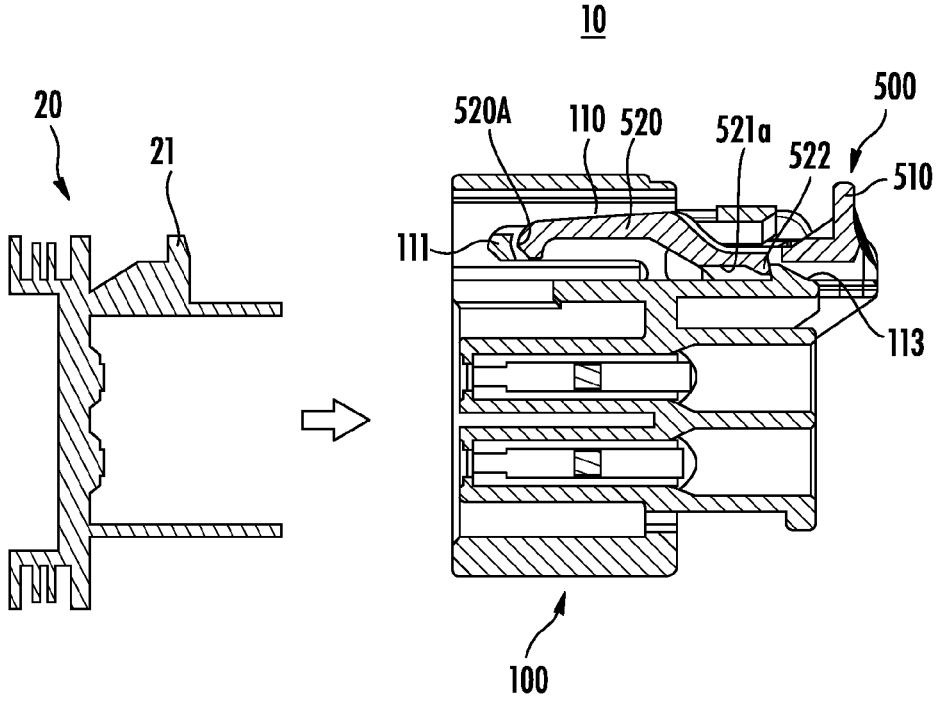
FIG. 7 is a cross-section showing the state in which the connector assembly and counterpart connector are fastened together.
Figure 8A:
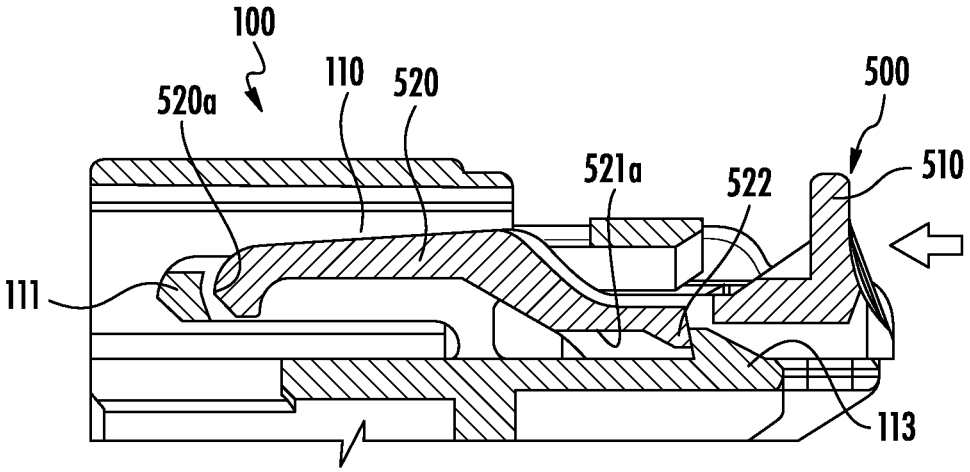
FIGS. 8A and 8B are cross-sections showing the prevention of slippages due to the edge when the CPA is fastened.
Figure 8B:
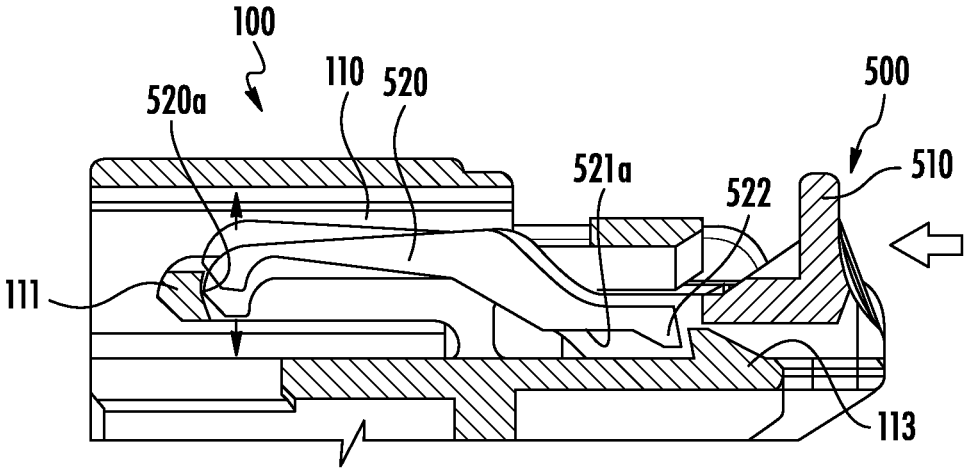

FIG. 7 is a cross-section showing the state in which the connector assembly and counterpart connector are fastened together; FIGS. 8A and 8B are cross-sections showing the prevention of slippages due to the edge when the CPA is fastened.

As shown in FIGS. 7, 8A and 8B, the CPA part 500 is inserted into the CPA insertion part 110 from the rear of the connector housing 100; the insertion force of the CPA part 500 must then, prior to the fastening of the counterpart connector 20, be at least 8.0 kgf. To that end, an edge 520*a* is formed on the front end of the locking lever 520 of the CPA part 500 so as to prevent slippage during CPA fastening.

Specifically, if as shown in FIG. 8A, the worker inserts the CPA part 500 into the CPA insertion part 110 so as to press the pressing plate 510 in the fastening direction, then as shown in FIG. 8B, the angular edge 520*a* formed on the front end of the locking lever 520 contacts the locking projection 111 and prevents vertical slippage of the locking lever 520 due to sagging, thus satisfying the requirement that the CPA insertion force be able to withstand at least 8.0 kgf.

In other words, by forming an edge 520*a* on the front end of the locking lever 520 of the CPA part 500, a strength is maintained that is sufficient to satisfy the 8.0 kgf insertion force required at CPA fastening, and the required CPA insertion force may be maintained by directly fixing the position of the locking lever 520 after contact with the locking projection 111 by the front edge 520*a* of the CPA part 500, counteracting the tendency of the locking lever 520 to move downward when the CPA is fastened.

FIGS. 9A through 9F are cross-sections showing, in sequence, the process of CPA fastening before and after fastening the connector assembly and counterpart connector.

The CPA part 500 is inserted at a downward inclination into the CPA insertion part 110 from the rear of the connector housing 100, and the CPA fastening force and removal force are satisfied by varying the angle of insertion depending on the stage of CPA insertion.

Figure 9A:
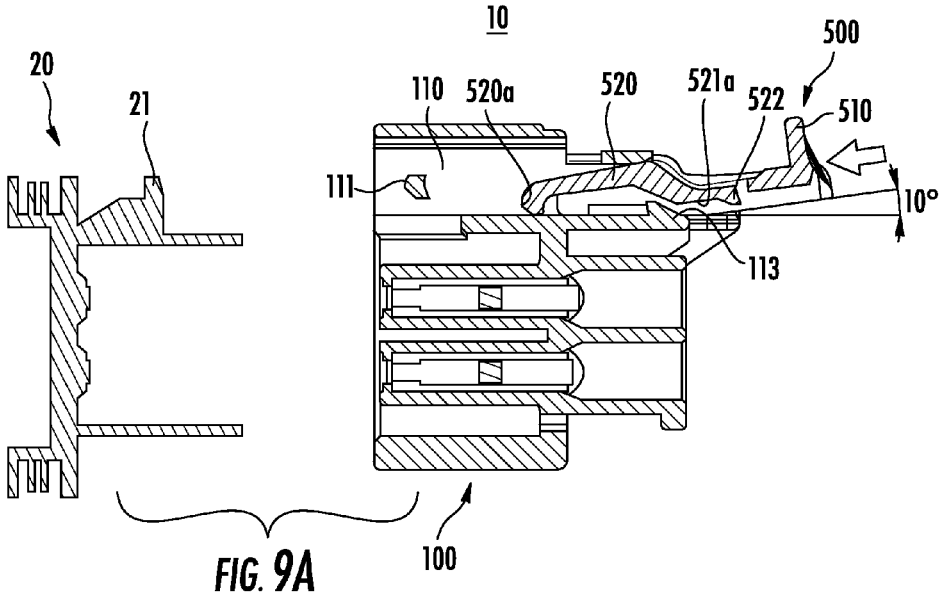
FIGS. 9A through 9F are cross-sections showing, in sequence, the process of CPA fastening before and after fastening the connector assembly and counterpart connector.

First, as shown in FIG. 9A, when the CPA part 500 is inserted into the CPA insertion part 110, the initial entry of the CPA part 500 into the CPA insertion part 110 begins at a downward angle of approximately 10 degrees, due to the interference between the bottom of the end supports 530 of the CPA part 500 and the bottom surface of the CPA insertion part 110 and the bottom of the side guide recesses 115, as well as the interference between the top of the locking lever 520 and the top of the CPA insertion part 110.

Figure 9B:
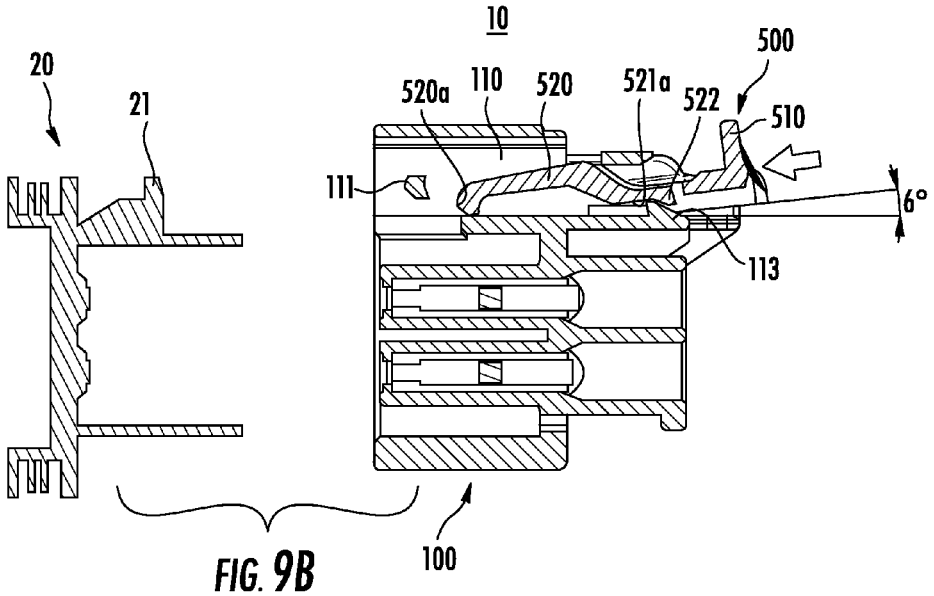

Next, as shown in FIG. 9B, if the CPA part 500 continues to be inserted in the assembly direction, it is fastened at an angle of approximately 6 degrees upon reaching the point where the inclined projection 113 formed on the rear interior of the CPA insertion part 110 is inserted into the inclined recess 521*a* formed on the bottom surface of the horizontal part 521 of the CPA part 500.

Figure 9C:
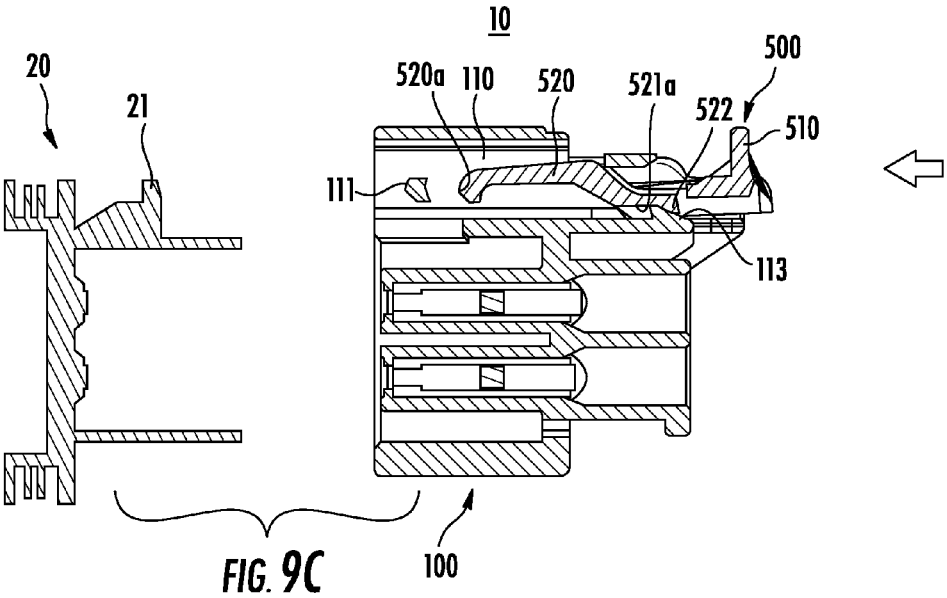

Next, as shown in FIG. 9C, the inclined recess 521*a* of the CPA part 500 moves to the inclined projection 113 so that, due to the angle of the inclined recess 521*a* and the angle of the inclined projection 113 being identical, the CPA part 500 becomes positioned horizontally, i.e. at 0 degrees.

Figure 9D:
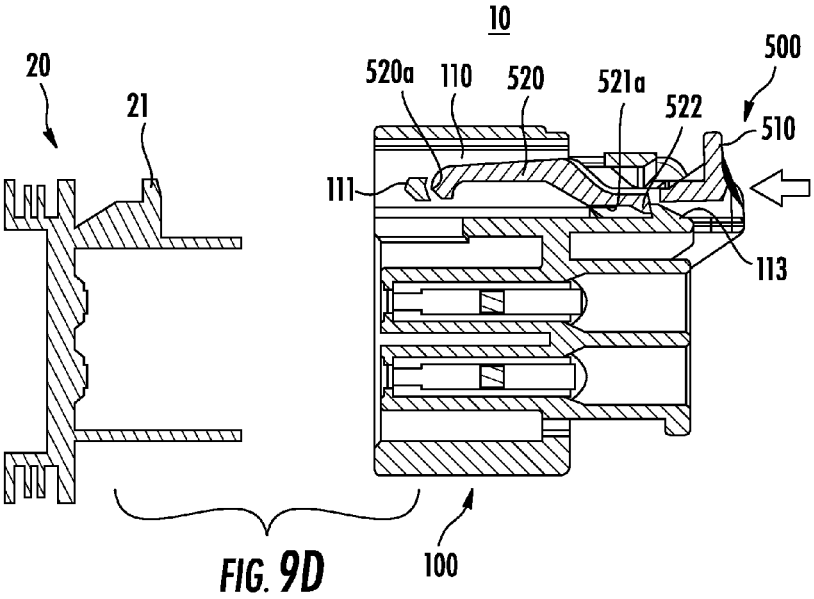

Next, as shown in FIG. 9D, if prior to the fastening of the counterpart connector 20 the CPA part 500 is pressed in the fastening direction so as to be completely fastened, then the angular edge 520*a* formed on the front end of the locking lever 520 of the CPA part 500 contacts the locking projection 111 formed on the forward interior of the CPA insertion part 110, and prevents vertical slippage, so as to satisfy the requirement that the CPA insertion force be able to withstand at least 8.0 kgf.

Figure 9E:
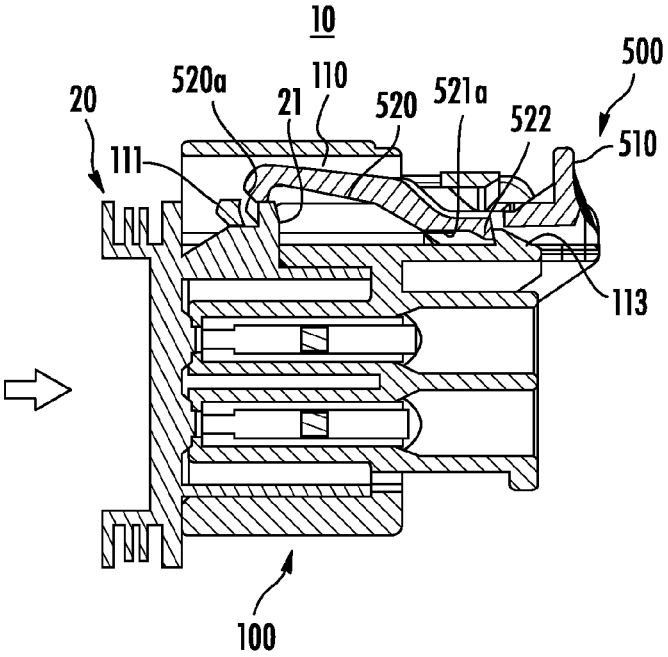

Next, as shown in FIG. 9E, when the CPA part 500 has been fastened to the connector housing 100, if the counterpart connector 20 is inserted into the opening 101 from the front of the connector housing 100 of the connector assembly 10, the front locking part 527 of the CPA part 500 is pushed upward by the locking projection 21 of the counterpart connector 20, and accordingly the front locking part 527 of the CPA part 500 is positioned above the locking projection 111 formed on the forward interior of the CPA insertion part 110.

Figure 9F:
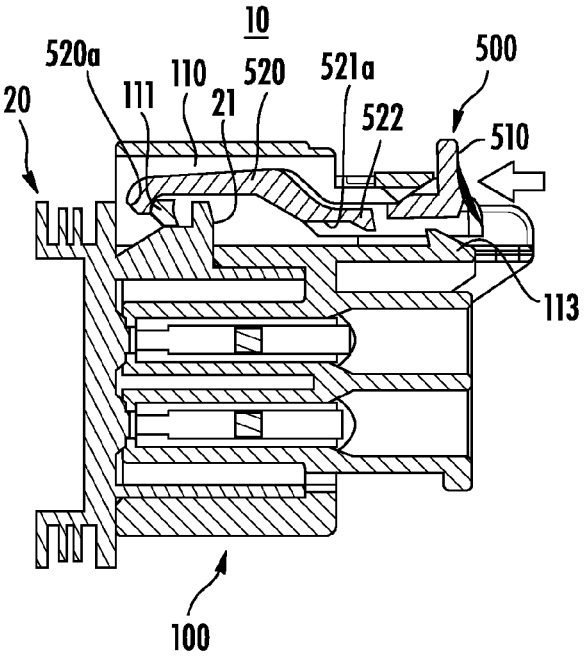

Finally, as shown in FIG. 9F, if the CPA part 500 is fully pushed in the fastening direction when the front locking part 527 of the CPA part 500 is located on top of the locking projection 111, the locking part 527 of the CPA part 500 passes over the locking projection 111 and descends so as to be locked in place. In addition, the locking projection 21 of the counterpart connector 20 catches on the locking projection 111 formed on the front interior of the CPA insertion part 110 and is locked in place, so as to completely fasten the counterpart connector 20 to the connector assembly 10, thus satisfying the requisite CPA insertion force and removal force.

Hereinabove, embodiments of this disclosure were described with reference to the attached drawings, but a person of ordinary skill in the art to which this disclosure pertains will be able to understand that this disclosure may be implemented in different specific forms without altering the necessary characteristics or technical idea thereof. Therefore, the embodiments described hereinabove must be understood as exemplary, rather than limiting, in all respects. The scope of this disclosure is set forth in the claims below rather than in the detailed description; all alterations or altered forms derived from the meaning, scope and equivalents of the claims must be considered to be included within the scope of this disclosure.

The invention claimed is:

1. A connector assembly comprising:

a housing having a forward opening and a connector position assurance (CPA) insertion part, the forward opening being configured to have a counterpart connector inserted therein, the CPA insertion part being formed on a side of the housing so that it is connected to the forward opening, the CPA insertion part having a locking protrusion formed on a forward interior thereof so as to prevent forward detachment of the counterpart connector inserted by locking the counterpart connector into a locking position; and a CPA part that is configured to assure the locking position of the counterpart connector, the CPA part configured to be inserted into the CPA insertion part via a rear of the housing, wherein the CPA part has a pressing plate, a locking lever and end supports, the pressing plate having a vertical planar surface, the locking lever extending forward at a center of the pressing plate, the end supports being formed at a front of either end of the pressing plate and extending so as to be shorter than the locking lever, wherein the locking lever has an edge formed on a front end thereof, a horizontal part, a bending part, a lever part and a locking part, the horizontal part extending horizontally in a bar shape alongside the end support, in the center of the pressing plate, the bending part extends bending upward from a front end of the horizontal part, the bending part having a rib formed on a bottom thereof for reinforcement, the lever part bent downward from a front end of the bending part and extending forward alongside the horizontal part, the locking part formed curving downward at the front end of the locking lever, wherein the edge contacts the locking protrusion so that when the CPA part is inserted into the CPA insertion part, before the counterpart connector is fastened, a front end of the CPA part prevents vertical slippage due to the edge, and a CPA insertion force is kept equal to or greater than a specified force, and wherein the CPA part is inserted at a downward angle of inclination into the CPA insertion part from behind the housing, and the downward angle of inclination is varied depending on a position of the CPA part relative to the CPA insertion part, so that requisite CPA fastening and removal forces are satisfied.

2. The connector assembly according to claim 1, wherein in the CPA part, a downward-curved curved surface on top of the front end of the locking lever intersects with an upward-inclined inclined surface on a bottom of the front end, so that the edge is formed protruding forward in an angular shape.

3. The connector assembly according to claim 1, wherein side guide recesses are formed on either side of a rear interior of the CPA insertion part, and wherein when the end supports are inserted into the side guide recesses, the CPA part is inserted at an initially downward incline into the CPA insertion part, due to interference between a bottom of the end supports and a bottom of the side guide recesses, and interference between a top of the locking lever and a top of the CPA insertion part.

4. The connector assembly according to claim 3, wherein an inclined projection is formed on a bottom surface of the rear interior of the CPA insertion part, and an inclined recess is formed on a bottom surface of the horizontal part of the locking lever, the inclined recess having an inclined surface corresponding to the inclined projection; and wherein the CPA part enters at a downward inclination when the inclined surface of the inclined recess meets the inclined projection when the CPA part is inserted into the CPA insertion part.

* * * * *